US010822902B2

(12) United States Patent
Davis et al.

(10) Patent No.: US 10,822,902 B2
(45) Date of Patent: Nov. 3, 2020

(54) RETRACTABLE PUMP DOWN RING

(71) Applicant: HALLIBURTON ENERGY SERVICES, INC., Houston, TX (US)

(72) Inventors: Kyle Davis, Celina, TX (US); Matthew James Merron, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 170 days.

(21) Appl. No.: 16/303,225

(22) PCT Filed: Jul. 20, 2016

(86) PCT No.: PCT/US2016/043091
§ 371 (c)(1),
(2) Date: Nov. 20, 2018

(87) PCT Pub. No.: WO2018/017073
PCT Pub. Date: Jan. 25, 2018

(65) Prior Publication Data

US 2019/0203551 A1 Jul. 4, 2019

(51) Int. Cl.
*E21B 10/10* (2006.01)
*E21B 23/06* (2006.01)
(Continued)

(52) U.S. Cl.
CPC ..... *E21B 23/10* (2013.01); *E21B 23/06* (2013.01); *E21B 23/08* (2013.01); *E21B 23/01* (2013.01);
(Continued)

(58) Field of Classification Search
CPC ..... E21B 23/10; E21B 23/06; E21B 23/08; E21B 23/01; E21B 33/128; E21B 33/1293
See application file for complete search history.

(56) References Cited

U.S. PATENT DOCUMENTS 4,944,351 A 7/1990 Eriksen et al.
6,167,963 B1 1/2001 McMahan et al.
(Continued)

FOREIGN PATENT DOCUMENTS

CA 2810045 A1 9/2013
CA 2840740 A1 2/2015

OTHER PUBLICATIONS

International Search Report and Written Opinion dated Apr. 18, 2017, issued in corresponding PCT Application No. PCT/US2016/043091.

*Primary Examiner* — David J Bagnell
*Assistant Examiner* — Yanick A Akaragwe
(74) *Attorney, Agent, or Firm* — McAfee & Taft

(57) ABSTRACT

A pump down ring is utilized in a downhole tool for use in a subterranean well. The pump down ring is positioned around the outer surface of a sleeve and is slidably disposed thereon. The pump down ring slidably engages the sleeve so as to have a radially-relaxed position and an expanded position where the pump down ring is expanded radially outward from the radially-relaxed position. Accordingly, the pump down ring can be placed in its expanded position to facilitate placement of the downhole tool in a wellbore by use of fluid pressure and can be placed in its radially-relaxed position to facilitate removal of the downhole tool from the wellbore.

20 Claims, 5 Drawing Sheets

(51) Int. Cl.

| | |
|---|---|
| ***E21B 23/10*** | (2006.01) |
| ***E21B 23/08*** | (2006.01) |
| *E21B 23/01* | (2006.01) |
| *E21B 33/128* | (2006.01) |
| *E21B 33/129* | (2006.01) |

(52) U.S. Cl.
CPC ..... *E21B 33/128* (2013.01); *E21B 33/1293* (2013.01)

(56) References Cited

U.S. PATENT DOCUMENTS

| | | | | |
|---|---|---|---|---|
| 8,336,616 | B1 | 12/2012 | McClinton | |
| 8,839,855 | B1 * | 9/2014 | McClinton ..... | E21B 33/1292 166/135 |
| 2011/0315403 | A1 | 12/2011 | Nard et al. | |
| 2013/0000887 | A1 | 1/2013 | Smith et al. | |
| 2013/0105144 | A1 | 5/2013 | Jordan et al. | |
| 2013/0138254 | A1 | 5/2013 | Seals et al. | |
| 2013/0264056 | A1 | 10/2013 | Stout | |
| 2015/0047827 | A1 | 2/2015 | Frazier | |

* cited by examiner

RETRACTABLE PUMP DOWN RING

FIELD

The present disclosure relates generally to equipment utilized in operations performed, in conjunction with subterranean wells and, more particularly, to pump down rings used with equipment.

BACKGROUND

In the drilling and reworking of oil wells, a great variety of downhole tools is used. For example, but not by way of limitation, downhole tools are used to seal tubing or other pipe in the well. Downhole tools referred to as packers, frac plugs and bridge plugs are designed for these general purposes and are well known in the art of producing oil and gas. Bridge plugs isolate the portion of the well below the bridge plug from the portion of the well thereabove such that there is no communication between the two well portions. Frac plugs, on the other hand, allow fluid flow in one direction but prevent flow in the other. For example, frac plugs set in a well may allow fluid from below the frac plug to pass upwardly therethrough but when the slurry is pumped into the well, the frac plug will not allow fluid flow therethrough so that any fluid being pumped down the well may be forced into a formation above the frac plug. In the course of treating and preparing subterranean wells for production, such plugs are run into the well on a work string, a production tubing or wireline. The plug is typically provided with anchor assemblies having opposed camming surfaces which cooperate with complementary opposed wedging surfaces; whereby the anchor slips are radially extendible into gripping engagement against the well casing bore in response to relative axial movement of the wedging surfaces. The plug also carries annular sealing elements, which are expandable radially into sealing engagement against the casing.

There are a number of situations in hydrocarbon wells where it is necessary or desirable to position a tool, such as the above-described plugs, at a predetermined location in the well. In vertical wells, tools are conventionally run on the bottom of a wire line and use gravity to cause the tool to fall into the well. In horizontal wells, gravity can be used in the vertical leg, but only for a very short distance into the horizontal leg. It has become customary to pump the tool on the end of a wire line to its desired location in the horizontal leg of a well. Pumping a liquid into the pipe string creates a dynamic pressure differential across the tool thereby propelling it along the horizontal leg. Because the tool is on the end of a wire line, the distance the tool is pumped can be controlled.

One problem with this approach is that substantial quantities of the pumped liquid are needed because creating a dynamic pressure drop across the tool requires that a large volume of liquid be pumped across the tool. In order to minimize the liquid needed and to better move the tool, pump down collars or rings have been used on the exterior of downhole tools to reduce the gap between the outside of the tool and the inside wall of the wellbore, which can be the inside of a casing in the wellbore.

The use of pump down rings is not without problems. A pump down ring that is too stiff will add friction and increase the possibility of getting stuck during run in. A pump down ring that is too flimsy will wear more and can invert, which allows more fluid to bypass the ring (partially defeating the purpose of the pump down ring). In some applications, the user needs the ability to pull the wireline back out of hole after setting the plug. Pump down rings installed by the wireline crew, which would be retrieved with the wireline, can pull the fluid column up the wellbore. Additionally, the pump down ring may swab out and create a vacuum making it difficult to pull out of the wellbore. These retrieval issues are also a problem when the wireline needs to be pulled out without setting the plug, thus, when the plug needs to be retrieved with the wireline.

BRIEF DESCRIPTION OF THE DRAWINGS

FIGS. 6A and 6B are cross-sectional views of the downhole tool of FIGS. 5A and 5B with the downhole tool in the set position.

DETAILED DESCRIPTION

Figure 1:
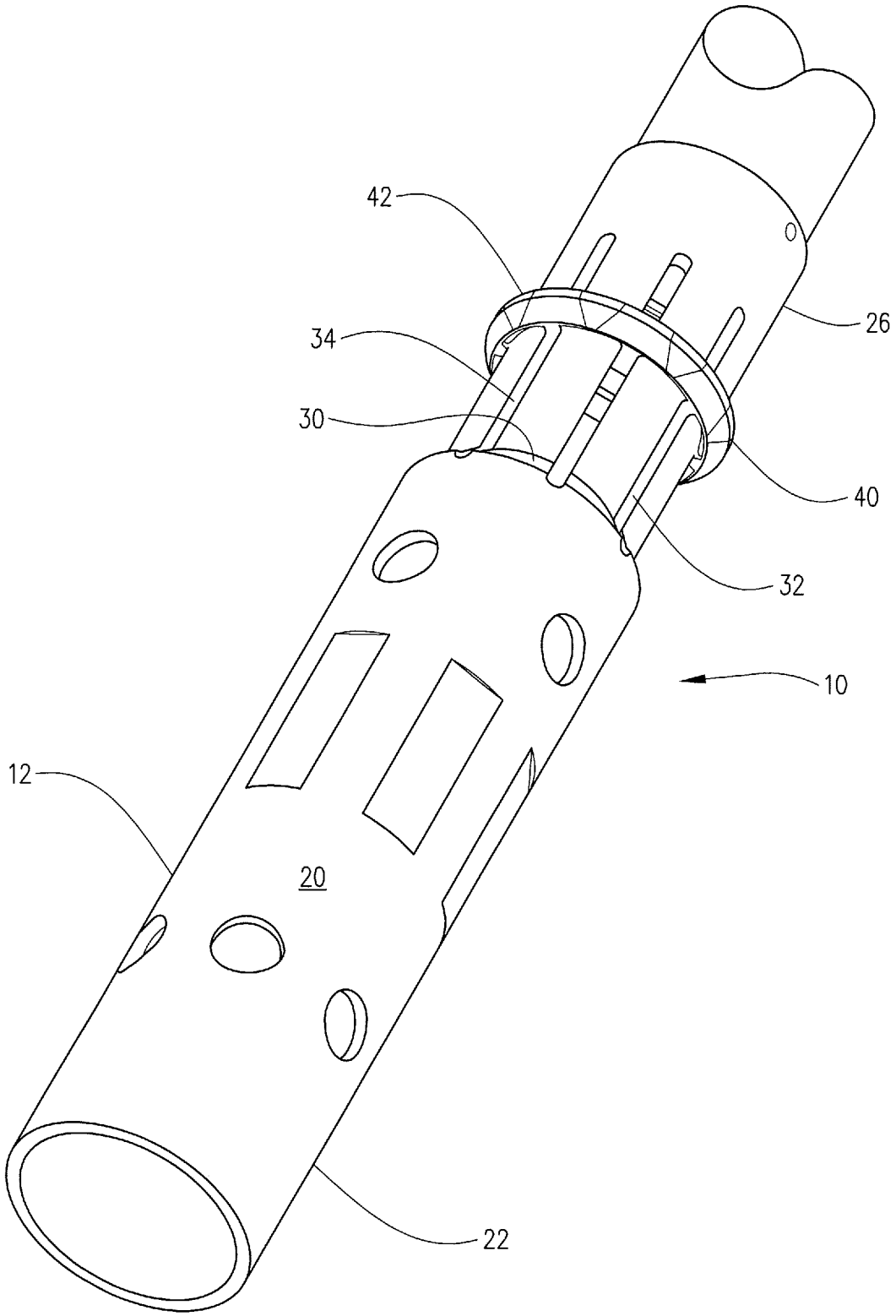
FIG. 1 is a perspective view of a schematic illustration of a pump-down-ring assembly in a radially-relaxed position in accordance with one embodiment.
Figure 2:
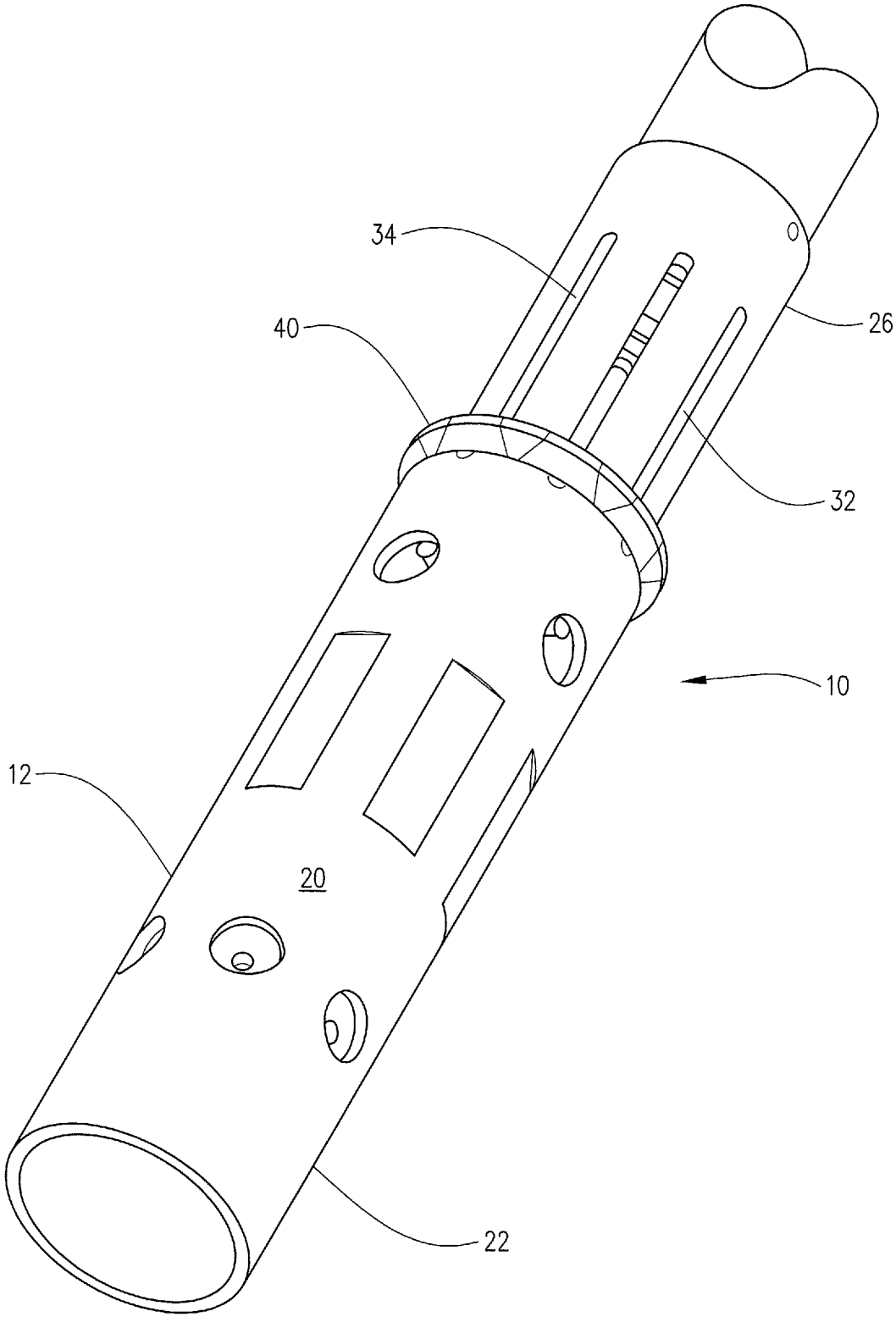
FIG. 2 is a perspective view of a schematic illustration of a pump-down-ring assembly in an expanded position in accordance with an embodiment.

In the description that follows, like parts are marked throughout the specification and drawings with the same reference numerals, respectively. The drawings are not necessarily to scale and the proportions of certain parts have been exaggerated to better illustrate details and features of the invention. In the following description, the terms "upper," "upward," "lower," "below," "downhole" and the like as used herein shall mean in relation to the bottom or furthest extent of the surrounding wellbore even though the wellbore or portions of it may be deviated or horizontal. The terms "inwardly" and "outwardly" are directions toward and away from, respectively, the geometric axis of a referenced object. Where components of relatively well-known designs are employed, their structure and operation will not be described in detail.

Referring now to the drawings, and more specifically to FIGS. 1-4, a pump-down-ring assembly 10 is illustrated. Pump-down-ring assembly 10 is shown in its expanded position in FIGS. 2 and 4 and in its radially relaxed position in FIGS. 1 and 3. Pump-down-ring assembly 10 generally comprises sleeve 12 and pump down ring 40.

Sleeve 12 is typically a cylindrical tube having a longitudinal axis 14 defining a longitudinal direction parallel with longitudinal axis 14, and defining a radial direction perpendicular to longitudinal axis 14. Sleeve 12 has an interior 16 defined by inner surface 18. As can be seen from the figures, interior 16 can be a central bore extending through sleeve 12. Sleeve 12 also has an outer surface 20 having a first section 22 and a second section 26. First section 22 has a first outer diameter 24 and second section 26 has a second outer diameter 28. First diameter 24 is greater than second diameter 28 so as to form a shoulder 30 on outer surface 20. As best seen from FIGS. 1 and 3, shoulder 30 will generally be an angular shoulder having an angle $\alpha$ with outer surface 20 of first section 22, wherein angle $\alpha$ is between 0 degrees and 90 degrees. More typically, the angle $\alpha$ will be from about 20 degrees to about 80 degrees, from about 30 degrees to about 60 degrees, from about 40 degrees to about 50 degrees, or about 45 degrees.

Additionally, sleeve 12 has slot edges 32 each defining a slot 34 in outer surface 20 of second section 26. Although there can only be one such slot, typically there will be a plurality of slots 34 with each slot 34 extending longitudinally along second section 26 so as to provide an aperture between outer surface 20 and inner surface 18 and thus into interior 16.

Pump down ring 40 comprises a generally circular ring 42 positioned around outer surface 20 of sleeve 12. Ring 42 will generally be positioned on second section 26 and slidably engage sleeve 12. Ring 42 is typically a resilient upward-facing cup and can be flexible or elastic. Ring 42 is located to slide from shoulder 30 to a position above shoulder 30; thus, ring 42 has an expanded position (illustrated in FIGS. 2 and 4) where ring 42 engages shoulder 30 and has a radially-relaxed position (illustrated in FIGS. 1 and 3) where ring 42 does not engage shoulder 30. As will be apparent from the figures, in the expanded position ring 42 is expanded radially outward from the radially-relaxed position. In other words, in the radially-relaxed position, ring 42 has a relaxed outer diameter 44, which can be approximately equal to or less than first diameter 24 of first section 22. In the expanded position, ring 42 has an expanded outer diameter 46, which is larger than outer diameter 44 and is also larger than first diameter 24.

Figure 3:
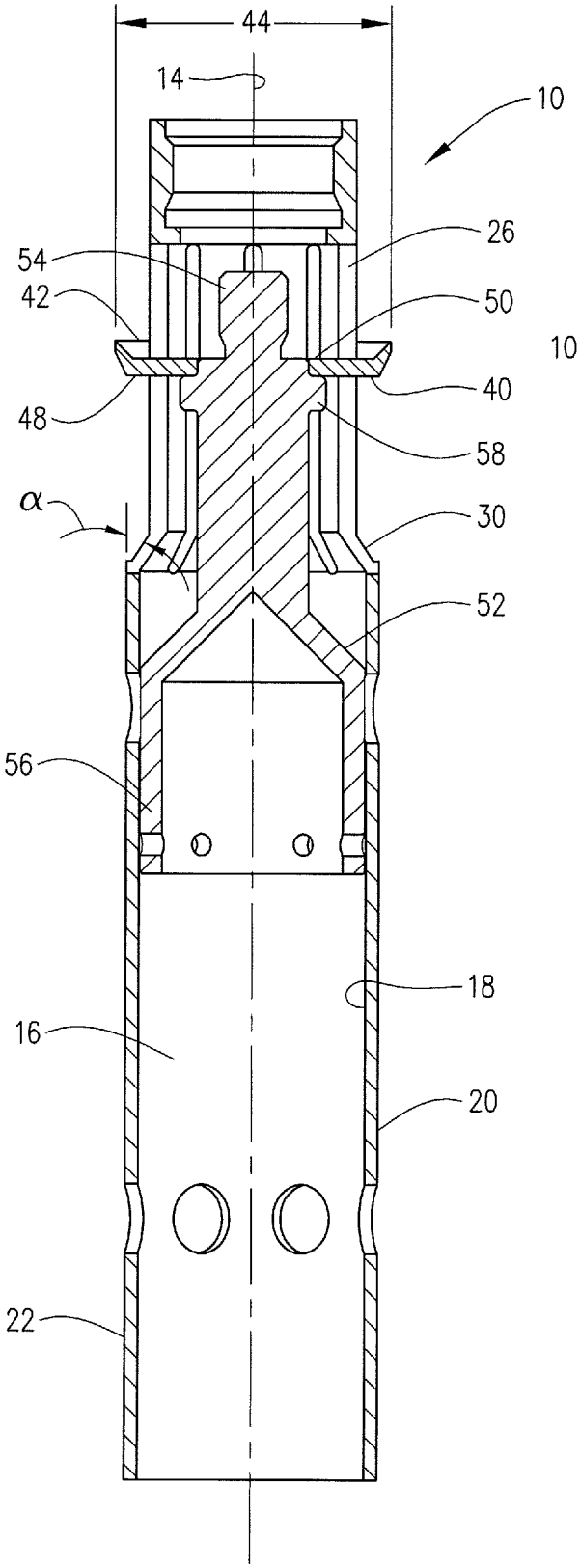
FIG. 3 is a cross-sectional view of the pump-down-ring assembly of FIG. 1.
Figure 4:
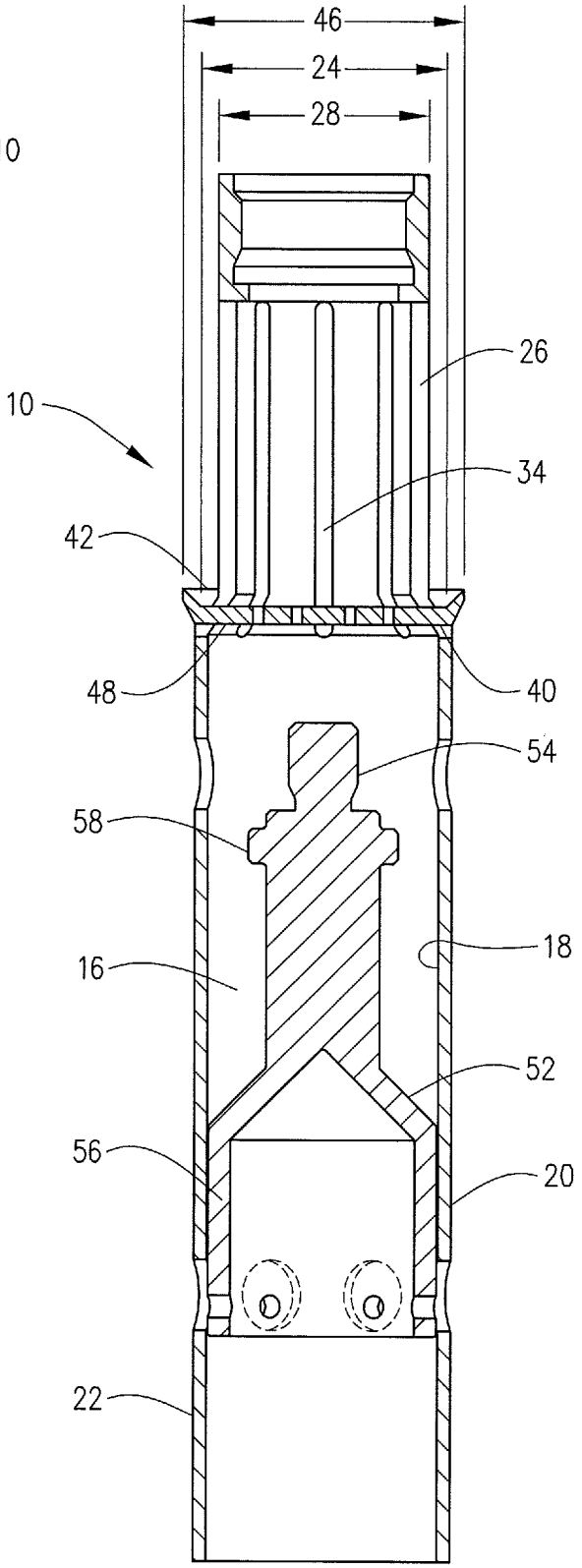
FIG. 4 is a cross-sectional view of the pump-down-ring assembly of FIG. 2.

Extending from ring 42 are radially-extending members 48, which extend radially inward through slots 34 so as to extend into interior 16 of sleeve 12. While it is within the scope of the invention for there to be only one radially-extending member 48 extending through one slot 34, more typically there will be a plurality of radially-extending members 48 with each member having an associated slot 34. In some embodiments, radially-extending members will be connected in interior 16 by an inner ring 50 (as shown in FIG. 3) or can be unconnected in interior 16 (as shown in FIG. 4).

Associated with pump-down-ring assembly 10 is tension mandrel 52. As shown, tension mandrel 52 is located within sleeve 12. Typically, when pump down ring 40 is in the expanded position, tension mandrel 52 will be located entirely within first section 22 of sleeve 12 (as shown in FIG. 4); however, it can be partially located within second section 26 as long as it does not interfere with pump down ring 40 being in the expanded position. When pump down ring 40 is in the radially-relaxed position, tension mandrel 52 will generally be at least partially within second section 26 (as shown in FIG. 3). Tension mandrel 52 has an upper end 54 configured to attach to a setting tool and a lower end 56 configured to attach to a downhole tool, such as a plug device (frac plug, packer, bridge plug, etc.). Additionally, upper end 54 is configured to engage radially-extending members 48 and/or inner ring 50 so that upward movement of tension mandrel 52 relative to pump-down-ring assembly 10 will move pump down ring 40 from the expanded position to the radially-relaxed position. In one embodiment, tension mandrel 52 has an outwardly protruding shoulder or ring 58 integrally formed thereon, which engages radially-extending members 48 and/or inner ring 50.

Figure 5A:
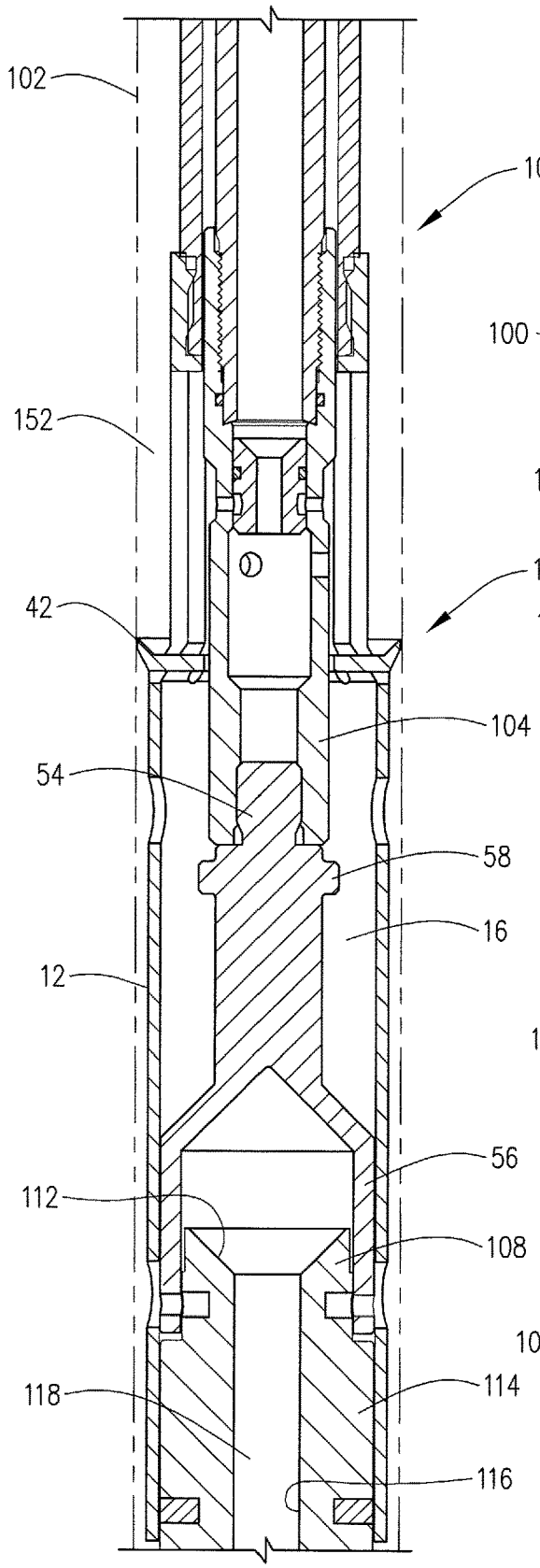
FIGS. 5A and 5B are cross-sectional views of a downhole tool incorporating a pump-down-ring assembly. The downhole tool is illustrated in the unset position.
Figure 5B:
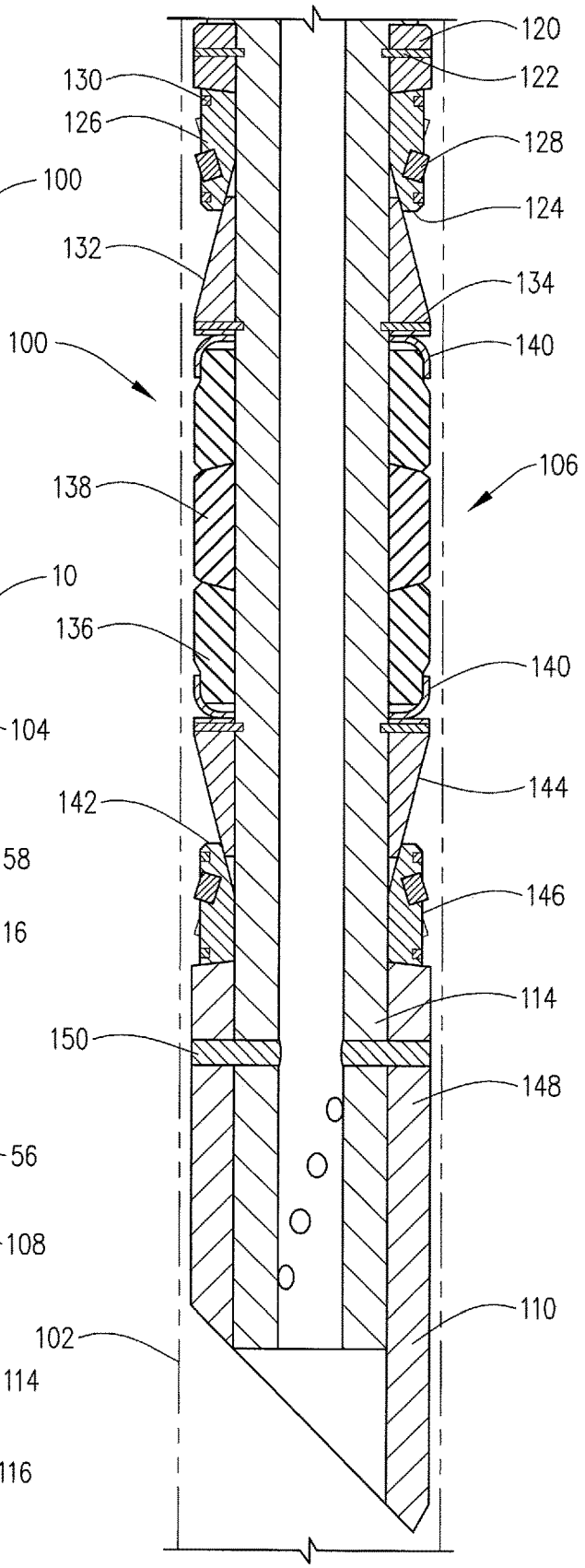
Figure 5A:
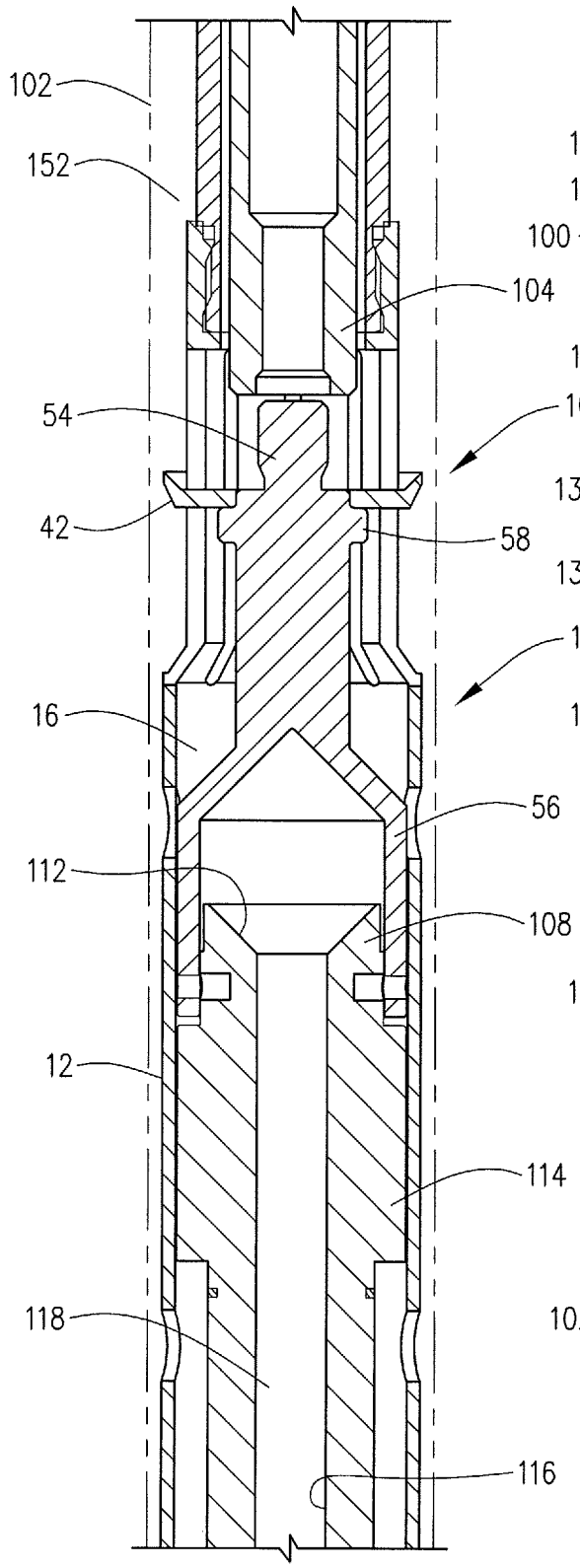
Figure 5B:
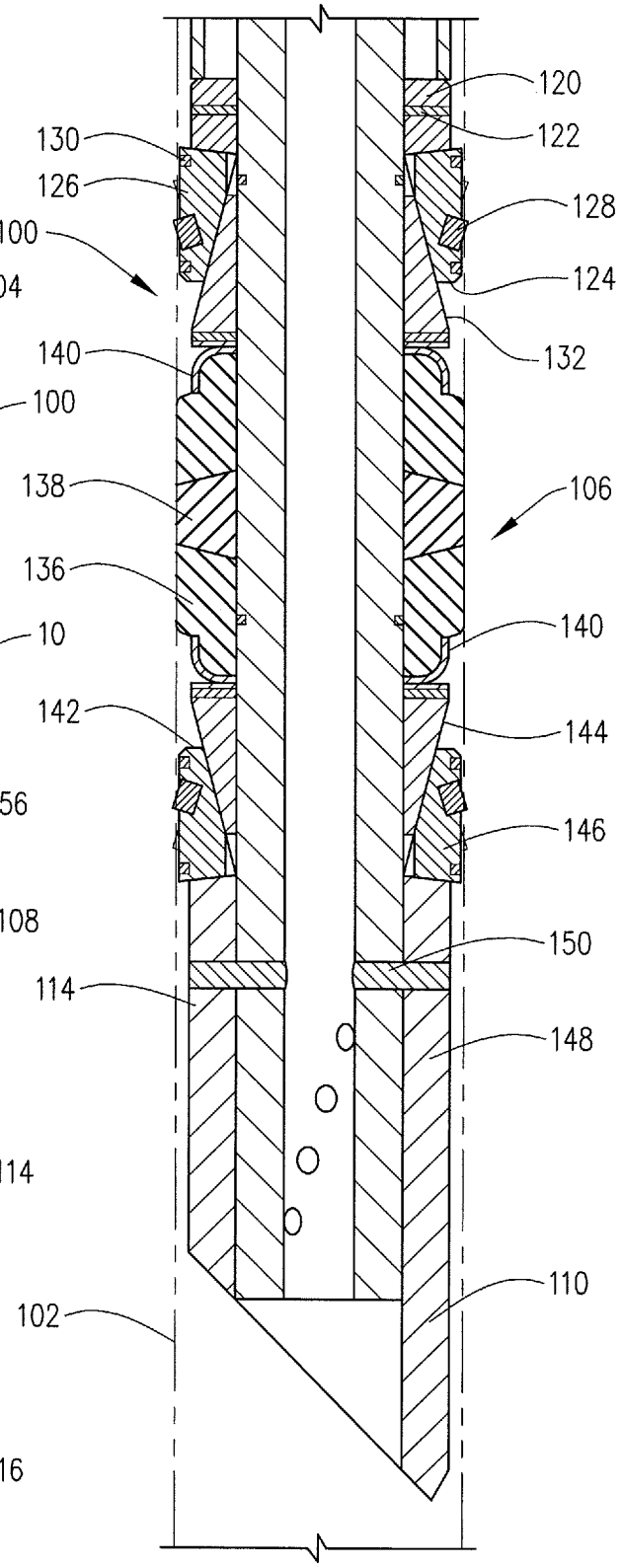

Turning now to FIGS. 5A, 5B, 6A and 6B, pump-down-ring assembly 10 will be further described as part of a downhole tool 100. In the discussion below, downhole tool 100 includes a frac plug 106; however, pump-down-ring assembly 10 can be used with other equipment. FIGS. 5A and 5B, schematically illustrate a downhole tool 100 in an unset position with frac plug 106 unset and pump-down-ring assembly 10 in the expanded position. FIGS. 6A and 6B schematically illustrate downhole tool 100 in a set position with frac plug 106 set and pump-down-ring assembly 10 in the radially-relaxed position. Downhole tool 100 is shown after having been lowered into a well having a wellbore wall 102. Pump-down-ring assembly 10 is useable in both cased and uncased wells; thus, "wellbore wall" will refer to both the inner wall of the casing and the uncased wall of the wellbore, as appropriate.

A setting tool 104 extends through interior 16 of sleeve 12 and connects to upper end 54 of tension mandrel 52. Lower end 56 of tension mandrel 52 is connected to upper end 108 of frac plug 106, typically by shear pins, shear screws or the like. Frac plug 106 has upper end 108 and a lower end 110.

Upper end 108 is configured to connect to tension mandrel 52. Additionally, upper end 108 has a plug seat 112 formed therein for receiving a plug (not shown). For a frac plug, the plug is general a ball plug which will prevent downward flow through frac plug 106 but allow upward flow. Frac plug 106 comprises a mandrel 114 forming upper end 108 and a lower end 110, and having an inner surface 116 defining a longitudinal central flow passage 118. Mandrel 114 defines plug seat 112. As shown, plug seat 112 is defined at the upper end 108 of mandrel 114.

Frac plug 106 further includes spacer ring 120 secured to mandrel 114 with shear pin 122. Spacer ring 120 provides an abutment which serves to axially retain slip segments 126 which are positioned circumferentially about mandrel 114. Frac plug 106 includes an upper anchoring assembly 124 disposed about mandrel 114. As illustrated, upper anchoring assembly 124 comprises slip segments 126 and slip wedge 132. Slip segments 126 may utilize buttons 128 or circumferentially extending wickers on their outer surface to engage wellbore wall 102 in the set position (illustrated in FIGS. 6A and 6B) and, thus, anchor frac plug 106. Buttons 128 can be ceramic buttons as described in detail in U.S. Pat. No. 5,984,007. Slip retaining bands 130 serve to radially retain slip segments 126 in an initial circumferential position about mandrel 114 as well as slip wedge 132. Bands 130 are made of a steel wire, a plastic material, or a composite material having the requisite characteristics of having sufficient strength to hold the slip segments 126 in place prior to actually setting frac plug 106 and to be easily drillable when frac plug 106 is to be removed from the wellbore. Preferably, bands 126 are inexpensive and easily installed about slip segments 126. Slip wedge 132 is initially positioned in a slidable relationship to, and partially underneath slip segment 126. Slip wedge 132 is shown pinned into place by shear pins 134. Located below upper slip wedge 132 is at least one sealing element and, as shown in the figures, a sealing element assembly 136 consists of three expandable sealing elements 138 disposed about packer mandrel 114. Shoes 140 are disposed at the upper and lower ends of sealing element assembly 136 and provide axial support thereto. The particular sealing element arrangement shown is merely representative as there are several sealing element arrangements known and used within the art.

Located below sealing element assembly 136 is lower anchoring assembly 142, which comprises slip wedge 144 and a plurality of slip segments 146, and is similar to upper anchoring assembly 124. Below slip segments 146, a mule shoe 148 is secured to mandrel 114 by radially oriented pins 150. Mule shoe 148 provides a lower abutment for anchor assembly 142. The lower most portion of downhole tool 100 need not be a mule shoe 148 but could be any type of section which serves to terminate the structure of downhole tool 100 or serves to be a connector for connecting downhole tool 100 with other tools, a valve, tubing or other downhole equipment.

The operation of downhole tool 100 is as follows. Downhole tool 100 is introduced and lowered into the wellbore utilizing setting tool 104 of a type known in the art. As the downhole tool 100 is lowered into the hole, flow through central flow passage 144 can be limited by setting tool 104, as needed. During introduction and lowering, pump down ring 40 is in its expanded position. Downward flowing fluid is introduced in an annulus 152 between wellbore wall 102 and downhole tool 100. The fluid interacts with pump down ring 42 so as to exert downward fluid pressure on pump down ring 42 and hence, on downhole tool 100. Thus, the fluid assists in movement of the downhole tool through the wellbore. The fluid assistance can be especially beneficial in diagonal and lateral stretches of the wellbore where gravity might be insufficient to move downhole tool 100 downward in the wellbore.

Once downhole tool 100 has been lowered to a desired position in the wellbore, setting tool 104 can be utilized to apply longitudinal force to tension mandrel 52, thus moving tension mandrel 52 upwards relative to sleeve 12. As tension mandrel 52 moves upward, ring 58 contacts radially-extending members 48 and/or inner ring 50 in the interior 16 of sleeve 12. As tension mandrel 52 continues to move upward, it now asserts upward force on radially-extending members 48 and causes pump down ring 40 to slide upward on sleeve 12 thus dislodging pump down ring 40 from shoulder 30. When pump down ring 40 dislodges from shoulder 30 it radially contracts to move to its radially-relaxed position. In the radially-relaxed position, pump down ring 40 receives less pressure from fluid in annulus 152. Thus, downward flowing fluid provides less downward pressure to downhole tool 100. Additionally, if downhole tool 100 is pulled upwards, there is less resistance to upward movement than when the pump down ring is in the expanded position. Frac plug 106 can now be set in the wellbore by continuing to apply upwards longitudinal force on tension mandrel 52. Alternatively, the system can be configured such that frac plug 106 is set prior to or simultaneous with moving pump ring 40 to its radially-relaxed position.

Tension mandrel 52 is connected to mandrel 114, thus mandrel 114 also moves upwards under the longitudinal force. Sleeve 12 contacts spacer ring 120, thus as mandrel 114 moves upwards, upper anchoring assembly 124, sealing element assembly 136 and lower anchoring assembly 142 all undergo longitudinal compression due to the longitudinal forces exerted by spacer ring 120 and mule shoe 148. This longitudinal compression moves upper anchoring assembly 124, sealing element assembly 136 and lower anchoring assembly 142 from their unset position to their set position as depicted in FIGS. 5A and 5B and FIGS. 6A and 6B, respectively. In the set position, slip segments 126, 146 and expandable packer elements 138 engage wellbore wall 102.

Once frac plug 106 is set in the wellbore, continued longitudinal force asserted by the setting tool can release tension mandrel 52 from frac plug 106. Once released, tension mandrel 52 and pump-down-ring assembly 10 can be retrieved from the wellbore with setting tool 104 or separately therefrom. Once the setting tool 104 is removed, a ball plug can be introduced downhole to the upper end 108.

In accordance with the above description, various embodiments will now be described. In a first embodiment there is provided a downhole tool for use in a wellbore defined by a wellbore wall extending through a subterranean formation. The downhole tool has a sleeve and a pump down ring. The sleeve has an interior and an outer surface. The outer surface has a first section having a first outer diameter and a second section having a second outer diameter. The first diameter is greater than the second diameter so as to form a shoulder on the outer surface. In some embodiments, the shoulder is an angled shoulder. The sleeve has a slot edge defining a slot in the outer surface of the second section, the slot extending longitudinally along the outer surface.

The pump down ring is positioned around the outer surface of the sleeve. In some embodiments, the pump down ring is an upwardly facing cup ring. The pump down ring has a radially-extending member, which extends radially inward through the slot so as to extend into the Interior of the sleeve. The pump down ring slidably engages the sleeve so as to have a radially-relaxed position where the pump down ring does not engage the shoulder, and an expanded position where the pump down ring engages the shoulder and is expanded radially outward from the radially-relaxed position.

In some embodiments, the sleeve comprises a plurality of slots in the second section. The slots extend longitudinally along the outer surface and are spaced around the circumference of the sleeve. The pump down ring can have a plurality of radially-extending members with each member associated with one of the slots so as to extend radially inward through the associated slot so as to extend into the interior of the sleeve. Further, an inner ring can be connected to the radial members such that the inner ring is in the interior.

In some of the above embodiments, the downhole tool can further comprise an anchor assembly and a tension mandrel. The anchor assembly has an anchor mandrel, a slip assembly disposed about the anchor mandrel and a sealing element disposed about the anchor mandrel. The anchor assembly has an unset position in which the slip assembly and sealing element are in a radially inward position and do not engage the wellbore wall, and a set position in which the slip assembly and sealing element are in a radially outward position and do engage the wellbore wall.

The tension mandrel is at least partially contained within the first section of the sleeve. The tension mandrel and sleeve engage with the anchor assembly and a setting tool such that force asserted by the setting tool moves the anchor assembly from the unset position to the set position and moves the pump down ring from the expanded position to the radially-relaxed position. In some embodiments, the tension mandrel engages with the inner ring so as to move the pump down ring from the expanded position to the radially-relaxed position.

In another embodiment, there is provided a process for introducing a downhole tool into a wellbore defined by a wellbore wall. The process comprises:

introducing the downhole tool into the wellbore, the downhole tool having a sleeve with a pump down ring disposed about it and a tension mandrel positioned at least partially in the sleeve, and wherein a setting tool is engaged with the sleeve and the tension mandrel and the pump down ring has an expanded position and a radially-relaxed position such that in the expanded position, the pump down ring is expanded radially outward from the radially-relaxed position;

lowering the downhole tool through the wellbore to a predetermined location using the setting tool and a fluid in an annulus between the wellbore wall and the downhole tool, wherein the fluid interacts with the pump down ring in the expanded position on the downhole tool so as to assist in movement of the downhole tool through the wellbore; and moving a tension mandrel upward in the sleeve using the setting tool such that the tension mandrel engages with the pump down ring to move the pump down ring from the expanded position to a radially-relaxed position.

In the process, the step of moving the tension mandrel can further comprise moving an anchorage assembly from an unset position to a set position. The tension mandrel and sleeve engage with the anchorage assembly. Further, the anchorage assembly can have a slip assembly and a sealing element such that in the unset position the slip assembly and sealing element are in a radially inward position and do not engage the wellbore wall, and in the set position the slip assembly and sealing element are in a radially outward position and do engage the wellbore wall.

In the above embodiments, when fluid is moving relative to the downhole tool, the movement of the fluid asserts force on the pump down ring in the expanded position to assist in movement and, when moved to the radially-relaxed position, the movement of the fluid asserts less force on the pump down ring than when the pump down ring is in the expanded position.

In the process, the step of the moving the tension mandrel can comprise the tension mandrel engaging the pump down ring so as to slide the pump down ring along the sleeve from the expanded position to the radially-relaxed position. In the expanded position, the pump down ring interacts with a radially-outward projecting shoulder on an outer surface of the sleeve so as to expand to a first outside diameter. In the radially-relaxed position, the pump down ring does not interact with the radially-outward projection shoulder and thus, when slid to the radially-relaxed position, the pump down ring retracts to a second outside diameter less than the first outside diameter.

In the above embodiments, the step of moving the tension mandrel can comprise a head portion of the tension mandrel passing into the inner ring so that a shoulder portion of the tension mandrel engages the inner ring thus moving the pump down ring along the sleeve as the tension mandrel moves in the sleeve.

Although the invention has been described with reference to a specific embodiment, the foregoing description is not intended to be construed in a limiting sense. Various modifications as well as alternative applications will be suggested to persons skilled in the art by the foregoing specification and illustrations. It is therefore contemplated that the appended claims will cover any such modifications, applications or embodiments as followed in the true scope of this invention.

What is claimed is:

1. A downhole tool for use in a wellbore defined by a wellbore wall extending through a subterranean formation, the downhole tool comprising:

a sleeve having an interior and an outer surface, the outer surface having a first section having a first outer diameter and a second section having a second outer diameter, wherein the first diameter is greater than the second diameter so as to form a shoulder on the outer surface, and wherein the sleeve has a slot edge defining a slot in the outer surface of the second section, the slot extending longitudinally along the outer surface;

a pump down ring positioned around the outer surface of the sleeve and having a radially-extending member, which extends radially inward through the slot so as to extend into the interior of the sleeve, wherein the pump down ring slidably engages the sleeve so as to have a radially-relaxed position where the pump down ring does not engage the shoulder, and an expanded position where the pump down ring engages the shoulder and is expanded radially outward from the radially-relaxed position.

2. The downhole tool of claim 1, wherein the pump-down ring is an upward-facing cup ring.

3. The downhole tool of claim 1, wherein the shoulder is an angled shoulder.

4. The downhole tool of claim 1, wherein the sleeve comprises a plurality of slots in the second section, the slots extending longitudinally along the outer surface and spaced around the circumference of the sleeve, and wherein the pump down ring has a plurality of radially-extending members with each member associated with one of the slots so as to extend radially inward through the associated slot so as to extend into the interior of the sleeve.

5. The downhole tool of claim 4, further comprising an inner ring connected to the radially-extending members such that the inner ring is in the interior.

6. The downhole tool of claim 1, further comprising:

an anchor assembly having an anchor mandrel, a slip assembly disposed about the anchor mandrel and a sealing element disposed about the anchor mandrel, wherein the anchor assembly has an unset position in which the slip assembly and sealing element are in a radially inward position and do not engage the wellbore wall, and a set position in which the slip assembly and sealing element are in a radially outward position and do engage the wellbore wall;

a tension mandrel at least partially contained within the first section of the sleeve, wherein the tension mandrel and sleeve engage with the anchor assembly and a setting tool such that force asserted by the setting tool moves the anchor assembly from the unset position to the set position and moves the pump down ring from the expanded position to the radially-relaxed position.

7. The downhole tool of claim 6, wherein the sleeve comprises a plurality of slots in the second section, the slots extending longitudinally along the outer surface and spaced around the circumference of the sleeve, and wherein the pump down ring has a plurality of radially-extending members with each radially-extending member associated with one of the slots so as to extend radially inward through the associated slot so as to extend into the interior of the sleeve.

8. The downhole tool of claim 7, further comprising an inner ring connected to the radially-extending members such that the inner ring is in the interior.

9. The downhole tool of claim 8, wherein the tension mandrel engages with the inner ring so as to move the pump down ring from the expanded position to the radially-relaxed position.

10. The downhole tool of claim 9, wherein the pump-down ring is an upward-facing cup ring.

11. The downhole tool of claim 10, wherein the shoulder is an angled shoulder.

12. A process for introducing a downhole tool into a wellbore defined by a wellbore wall, the process comprising:

introducing the downhole tool into the wellbore, the downhole tool having a sleeve with a pump down ring disposed about it and a tension mandrel positioned at least partially in the sleeve, and wherein a setting tool is engaged with the sleeve and the tension mandrel and the pump down ring has an expanded position and a radially-relaxed position such that in the expanded position, the pump down ring is expanded radially outward from the radially-relaxed position;

lowering the downhole tool through the wellbore to a predetermined location using the setting tool and a fluid in an annulus between the wellbore wall and the downhole tool, wherein the fluid interacts with the pump down ring in the expanded position on the downhole tool so as to assist in movement of the downhole tool through the wellbore; and moving the tension mandrel upward in the sleeve using the setting tool such that the tension mandrel engages with the pump down ring to move the pump down ring from the expanded position to a radially-relaxed position.

13. The process of claim 12, wherein the step of moving the tension mandrel further comprises moving an anchorage assembly from an unset position to a set position, wherein the tension mandrel and sleeve engage with the anchorage assembly and the anchorage assembly has a slip assembly and a sealing element such that in the unset position the slip assembly and sealing element are in a radially inward position and do not engage the wellbore wall, and in the set position the slip assembly and sealing element are in a radially outward position and do engage the wellbore wall.

14. The process of claim 12, wherein, when fluid is moving relative to the downhole tool, the movement of the fluid asserts force on the pump down ring in the expanded position to assist in movement and, when moved to the radially-relaxed position, the movement of the fluid asserts less force on the pump down ring than when the pump down ring is in the expanded position.

15. The process of claim 12, wherein the step of the moving the tension mandrel comprises the tension mandrel engaging the pump down ring so as to slide the pump down ring along the sleeve from the expanded position, where the pump down ring interacts with a radially-outward projecting shoulder on an outer surface of the sleeve so as to expand to a first outside diameter, to the radially-relaxed position, where the pump down ring does not interact with the radially-outward projection shoulder and thus retracts to a second outside diameter less than the first outside diameter.

16. The process of claim 15, wherein the pump down ring comprises the sleeve and comprises a plurality of slots, the slots extending longitudinally along the outer surface and spaced around the circumference of the sleeve, and wherein the pump down ring has a plurality of radially-extending members with each radially-extending member associated with one of the slots so as to extend radially inward through the associated slot so as to extend into the interior of the sleeve where an inner ring connects the radially-extending members such that the inner ring is in the interior.

17. The process of claim 16, wherein the step of moving the tension mandrel comprises a head portion of the tension mandrel passing into the inner ring so that a shoulder portion of the tension mandrel engages the inner ring thus moving the pump down ring along the sleeve as the tension mandrel moves in the sleeve.

18. The process of claim 17, wherein the step of moving the tension mandrel further comprises moving an anchorage assembly from an unset position to a set position, wherein the tension mandrel and sleeve engage with the anchorage assembly and the anchorage assembly has a slip assembly and a sealing element such that in the unset position the slip assembly and sealing element are in a radially inward position and do not engage the wellbore wall, and in the set position, the slip assembly and sealing element are in a radially outward position and do engage the wellbore wall.

19. The process of claim 18, wherein the step of moving the tension mandrel further comprises moving the anchorage assembly from an unset position to a set position, wherein the tension mandrel and sleeve engage with the anchorage assembly and the anchorage assembly has a slip assembly and a sealing element such that in the unset position the slip assembly and sealing element are in a radially inward position and do not engage the wellbore wall, and in the set position the slip assembly and sealing element are in in a radially outward position and do engage the wellbore wall.

20. The process of claim 19, wherein, when fluid is moving relative to the downhole tool, the movement of the fluid asserts force on the pump down ring in the expanded position to assist in movement and, when moved to the radially-relaxed position, the movement of the fluid asserts less force on the pump down ring than when the pump down ring is in the expanded position.

* * * * *